US005468411A

United States Patent [19]

Dixit et al.

[11] Patent Number: 5,468,411

[45] Date of Patent: Nov. 21, 1995

[54] POWDERED AUTOMATIC DISHWASHING COMPOSITION CONTAINING ENZYMES

[75] Inventors: Nagaraj S. Dixit, Plainsboro; Robert D'Ambrogio, Piscataway; Divaker Kenkare, Asbury, all of N.J.; Julien Drapier, Seraing, Belgium

[73] Assignee: Colgagte Palmolive Co., Piscataway, N.J.

[21] Appl. No.: 147,413

[22] Filed: Nov. 5, 1993

Related U.S. Application Data

[63] Continuation-in-part of Ser. No. 932,124, Aug. 19, 1992, abandoned, which is a continuation-in-part of Ser. No. 800,297, Nov. 29, 1991, abandoned, which is a continuation-in-part of Ser. No. 708,576, May 31, 1991, Pat. No. 5,173,207, and a continuation-in-part of Ser. No. 708,559, May 31, 1991, abandoned, and a continuation-in-part of Ser. No. 708,557, May 31, 1991, abandoned.

[51] Int. Cl.[6] ..... C11D 3/386; C11D 3/37; C11D 3/08/3; C11D 395

[52] U.S. Cl. ..... 252/99; 252/174.23; 252/174.24; 252/DIG. 12; 252/174.12; 252/95; 435/219; 435/220; 435/221

[58] Field of Search ..... 252/174.23, 174.24, 252/174.12, DIG. 12, 95, 99, 174.25; 435/219–221

[56] References Cited

U.S. PATENT DOCUMENTS

| | | | |
|---|---|---|---|
| 4,162,987 | 7/1979 | Maguire et al. | 252/135 |
| 4,597,886 | 7/1986 | Goedhart et al. | 252/95 |
| 4,931,203 | 6/1990 | Ahmed et al. | 252/99 |
| 5,173,207 | 12/1992 | Drapier | 252/99 |
| 5,205,954 | 4/1993 | Ahmed | 252/99 |
| 5,240,632 | 8/1993 | Brumbaugh | 252/95 |
| 5,292,446 | 3/1994 | Painter et al. | 252/99 |

*Primary Examiner*—Linda Skaling
*Assistant Examiner*—Kay A. Fries
*Attorney, Agent, or Firm*—Richard E. Nanfeldt; Robert C. Sullivan; Murray Grill

[57] ABSTRACT

A phosphate-free powdered dishwashing composition containing a mixture of a protease enzyme and an amylase enzymes have been found to be very useful in the cleaning of dishware. The compositions contain nonionic surfactants and a alkali metal silicate and bleaching agent.

25 Claims, No Drawings

POWDERED AUTOMATIC DISHWASHING COMPOSITION CONTAINING ENZYMES

This application is a continuation-in-part of application Ser. No. 7/932,124 filed on Aug. 19, 1992, now abandoned, which in turn is a continuation in part application of U.S. Ser. No. 07/800,297 filed Nov. 29, 1991, now abandoned, which in turn is a continuation in part application of U.S. Ser. No. 07/708,576 filed May 31, 1991, now U.S. Pat. No. 4,173,707, and is also a continuation in part application of U.S. Ser. No. 708,559 filed May 31, 1991, now abandoned and is also a continuation in part application of U.S. Ser. No. 708,557 filed May 31, 1991, now abandoned.

FIELD OF THE INVENTION

This invention relates to an improved powdered phosphate-free automatic dishwashing detergent for dishwashing machines. More particularly, this invention relates to a concentrated powdered dishwashing composition which contains enzymes and is phosphate-free.

BACKGROUND OF THE INVENTION

It has been found to be very useful to have enzymes in dishwashing detergent compositions because enzymes are very effective in removing food soils from the surface of glasses, dishes, pots, pans and eating utensils. The enzymes attack these materials while other components of the detergent will effect other aspects of the cleaning action. However, in order for the enzymes to be highly effective, the composition must be chemically stable, and it must maintain an effective activity a the operating temperature of the automatic dishwasher. Chemical stability such as to bleach agents is the property whereby the detergent composition containing enzymes does not undergo any significant degradation during storage. Activity is the property of maintaining enzyme activity during usage. From the time that a detergent is packaged until it is used by the customer, it must remain stable. Furthermore, during customer usage of the dishwashing detergent, it must retain its activity. Unless the enzymes in the detergent are maintained in a minimum exposure moisture and water, the enzymes will suffer a degradation during storage which will result in a product that will have a decreased activity. When enzymes are a part of the detergent composition, it has been found that the initial water content of the components of the composition should be as low a level as possible, and this low water content must be maintained during storage, since water will deactivate the enzymes. This deactivation will cause a decrease in the initial deactivity of the detergent composition.

After the detergent container is opened, the detergent will be exposed to the environment which contains moisture. During each instance that the detergent is exposed to the environment it could possibly absorb some moisture. This absorption occurs by components of the detergent composition absorbing moisture, when in contact with the atmosphere. This effect is increased as the container is emptied, since there will be a greater volume of air in contact with the detergent, and thus more available moisture to be absorbed by the detergent composition. This will usually accelerate the decrease in the activity of the detergent composition. The one way to keep a high activity is to start with an initial high activity of enzyme and to use components in the dishwashing composition which do not interact with the enzyme and which have a low water affinity which will minimize any losses in activity as the detergent is being stored or used.

Powdered detergent compositions which contain enzymes can be made more stable and to have a high activity, if the initial free water content of the detergent composition is less than about 10 percent by weight, more preferably less than about 9 percent by weight and most preferably less than about 8 percent by weight. Furthermore, the pH of a 1.0 wt. % aqueous solution of the powdered detergent composition should be less than about 10.5 more preferably less than about 10.0, and most preferably less than about 9.5. This low alkalinity of the dishwashing detergent should maintain the stability of the detergent composition which contains a mixture of enzymes, thereby providing a higher initial activity of the mixture of the enzymes and the maintenance of this initial high activity.

A major concern in the use of automatic dishwashing compositions is the formulation of phosphate-free compositions which are safe to the environment while maintaining superior cleaning performance and dish care. The present invention teaches the preparation and use of powdered automatic dishwashing compositions which are phosphate-free and have superior cleaning performance and dish care.

SUMMARY OF THE INVENTION

This invention is directed to producing powdered phosphate-free enzyme-containing automatic dishwashing detergent compositions that have an increased chemical stability and essentially a high activity at wash operating temperatures of about 40° C. to 65° C., wherein the composition also can be used as a laundry presoaking agent. This is accomplished by controlling the alkalinity of the detergent composition and using a unique mixture of enzymes. An alkali metal silicate is used in the powdered dishwashing detergent compositions. The preferred builder system of the instant compositions comprises a mixture of sodium carbonate and/or sodium citrate and a low molecular weight polyacrylic polymer.

It is to be understood that the term powder in this invention includes within its definition tablets, soluble capsules and soluble sachet. It is also possible to use the instant compositions as a laundry presoaking powder.

Conventional powdered automatic dishwashing compositions usually contain a low foaming surface-active agent, a chlorine bleach, alkaline builder materials, and usually minor ingredients and additives. The incorporation of chlorine bleach requires special processing and storage precautions to protect composition components which are subject to deterioration upon direct contact with the active chlorine. The stability of the chlorine bleach is also critical and raises additional processing and storage difficulties. In addition, it is known that automatic dishwasher detergent compositions may tarnish silverware and damage metal trim on china as a result of the presence of a chlorine-containing bleach therein. Accordingly, there is a standing desire to formulate detergent compositions for use in automatic dishwashing operations which are free of active chlorine and which are capable of providing overall hard surface cleaning and appearance benefits comparable to or better than active chlorine-containing detergent compositions. This reformulation is particularly delicate in the context of automatic dishwashing operations, since during those operations, the active chlorine prevents the formation and/or deposition of troublesome protein and protein-grease complexes on the hard dish surfaces and no surfactant system currently known is capable of adequately performing that function.

Various attempts have been made to formulate bleach-free low foaming detergent compositions for automatic dishwashing machines, containing particular low foaming nonionics, builders, filler materials and enzymes. U.S. Pat. No. 3,472,783 to Smille recognized that degradation of the enzyme can occur, when an enzyme is added to a highly alkaline automatic dishwashing detergent.

French Patent No. 2,102,851 to Colgate-Palmolive, pertains to rinsing and washing compositions for use in automatic dishwashers. The compositions disclosed have a pH of about 6 to 7 and contain an amylolytic and, if desired, a proteolytic enzyme, which have been prepared in a special manner from animal pancreas and which exhibit a desirable activity at a pH in the range of about 6 to 7. German Patent No. 2,038,103 to Henkel & Co. relates to aqueous liquid or pasty cleaning compositions containing phosphate salts, enzymes and an enzyme stabilizing compound. U.S. Pat. No. 3,799,879 to Francke et al, teaches a detergent composition for cleaning dishes, with a pH of from 7 to 9 containing an amylolytic enzyme, and in addition, optionally a proteolytic enzyme.

U.S. Pat. No. 4,101,457, to Place et al., teaches the use of a proteolytic enzyme having a maximum activity at a pH of 12 in an automatic dishwashing detergent.

U.S. Pat. No. 4,162,987, to Maguire et al., teaches a granular or liquid automatic dishwashing detergent which uses a proteolytic enzyme having a maximum activity at a pH of 12 as well as an amylolytic enzyme having a maximum activity at a pH of 8.

U.S. Pat. No 3,827,938, to Aunstrup et al., discloses specific proteolytic enzymes which exhibit high enzymatic activities in highly alkaline systems. Similar disclosures are found in British Patent Specification No. 1,361,386, to Novo Terapeutisk Laboratorium NS. British Patent Specification No. 1,296,839, to Novo Terapeutisk Laboratorium A/S, discloses specific amylolytic enzymes which exhibit a high degree of enzymatic activity in alkaline systems.

Thus, while the prior art clearly recognizes the disadvantages of using aggressive chlorine bleaches in automatic dishwashing operations and also suggests bleach-free compositions made by leaving out the bleach component, said art disclosures are silent about how to formulate an effective bleach-free powdered automatic dishwashing compositions capable of providing superior performance during conventional use.

U.S. Pat. Nos. 3,821,118 and 3,840,480; 4,568,476, 4,501,681 and 4,692,260 teach the use of enzymes in automatic dishwashing detergents, as well as Belgian Patent 895,459; French Patents 2,544,393 and 1,600,256; European Patents 256,679; 266,904; 271,155; 139,329; and 135,226; and Great Britain Patent 2,186,884.

The aforementioned prior art fails to provide a powdered automatic dishwashing detergent which is phosphate-free and contains a mixture of enzymes for the simultaneous degradation of both proteins and starches, wherein the combination of enzymes have a maximum activity at a pH of less than about 10 as measured by Anson method and the powdered automatic dishwashing detergent has optimized cleaning performance in a temperature range of about 40° C. to about 65° C.

It is an object of this invention to incorporate an enzyme mixture in a phosphate-free, powdered automatic dishwasher detergent composition for use in automatic dishwashing operations capable of providing at least equal or better performance to conventional automatic dishwashing compositions at operating temperatures of about 40° C. to about 65° C.

DETAILED DESCRIPTION

The present invention relates to a powdered automatic dishwashing detergent compositions which comprise a nonionic surfactant, alkali metal silicate, a phosphate-free builder system, a peroxygen compound with activator as a bleaching agent and a mixture of an amylase enzyme and at least one protease enzyme, wherein the powdered automatic dishwashing detergent composition has a pH of about 11 in the washing liquor at a concentration of 10 grams per liter of water and the powdered dishwashing detergent composition exhibits high cleaning efficiency for both proteins and starches at a wash temperature of about 40° C. to about 65° C.

The nonionic surfactants that can be used in the present powdered automatic dishwasher detergent compositions are well known. A wide variety of these surfactants can be used.

The nonionic synthetic organic detergents are generally described as ethoxylated propoxylated fatty alcohols which are low-foaming surfactants and are possibly capped, characterized by the presence of an organic hydrophobic group and an organic hydrophilic group and are typically produced by the condensation of an organic aliphatic or alkyl aromatic hydrophobic compound with ethylene oxide and/or propyleneoxide (hydrophilic in nature). Practically any hydrophobic compound having a carboxy, hydroxy, amido or amino group with a free hydrogen attached to the oxygen or the nitrogen can be condensed with ethylene oxide or propylene oxide or with the polyhydration product thereof, polyethylene glycol, to form a nonionic detergent. The length of the hydrophilic or polyoxy ethylene chain can be readily adjusted to achieve the desired balance between the hydrophobic and hydrophilic groups. Typical suitable nonionic surfactants are those disclosed in U.S. Pat. Nos. 4,316,812 and 3,630,929.

Preferably, the nonionic detergents that are used are the low-foaming polyalkoxylated lipophiles wherein the desired hydrophile-lipophile balance is obtained from addition of anhydrophilic poly-lower alkoxy group to a lipophilic moiety. A preferred class of the nonionic detergent employed is the poly-lower alkoxylated higher alkanol wherein the alkanol is of 9 to 18 carbon atoms and wherein the number of moles of lower alkylene oxide (of 2 or 3 carbon atoms) is from 3 to 15. Of such materials it is preferred to employ those wherein the higher alkanol is a high fatty alcohol of 9 to 11 or 12 to 15 carbon atoms and which contain from 5 to 15 or 5 to 16 lower alkoxy groups per mole. Preferably, the lower alkoxy is ethoxy but in some instances, it may be desirably mixed with propoxy, the latter, if present, usually being major (more than 50%) portion. Exemplary of such compounds are those wherein the alkanol is of 12 to 15 carbon atoms and which contain about 7 ethylene oxide groups per mole.

Useful nonionics are represented by the low foam Plurafac series from BASF Chemical Company which are the reaction product of a higher linear alcohol and a mixture of ethylene and propylene oxides, containing a mixed chain of ethylene oxide and propylene oxide, terminated by a hydroxyl group. Examples include Product A(a $C_{13}$–$C_{15}$ fatty alcohol condensed with 6 moles ethylene oxide and 3 moles propylene oxide). Product B (a $C_{13}$–$C_{15}$ fatty alcohol condensed with 7 mole propylene oxide and 4 mole ethylene oxide), and Product C (a $C_{13}$–$C_{15}$ fatty alcohol condensed with 5 moles propylene oxide and 10 moles ethylene oxide).

Particularly good surfactants are Plurafac LF132 and LF 231 which are capped nonionic surfactants. Another liquid nonionic surfactant that can be used is sold under the tradename Lutensol SC 9713.

Synperonic nonionic surfactant from ICI such as Synperonic LF/D25 are especially preferred nonionic surfactants that can be used in the powdered automatic dishwasher detergent compositions of the instant invention.

Other useful surfactants are Neodol 25-7 and Neodol 23-6.5, which products are made by Shell Chemical Company, Inc. The later is a condensation product of a mixture of higher fatty alcohols averaging about 12 to 13 carbon atoms and the number of ethylene oxide groups present averages about 6.5. The higher alcohols are primary alkanols. Other examples of such detergents include Tergitol 15-S-7 and Tergitol 15-S-9 (registered trademarks), both of which are linear secondary alcohol ethoxylates made by Union Carbide Corp. The former is mixed ethoxylation product of 11 to 15 carbon atoms linear secondary alkanol with seven moles of ethylene oxide and the latter is a similar product but with nine moles of ethylene oxide being reacted.

Also useful in the present compositions as a component of the nonionic detergent are higher molecular weight nonionics, such as Neodol 45-11, which are similar ethylene oxide condensation products of higher fatty alcohols, with the higher fatty alcohol being of 14 to 15 carbon atoms and the number of ethylene oxide groups per mole being about 11. Such products are also made by Shell Chemical Company.

In the preferred poly-lower alkoxylated higher alkanols, to obtain the best balance of hydrophilic and lipophilic moieties the number of lower alkoxies will usually be from 40% to 100% of the number of carbon atoms in the higher alcohol, preferably 40 to 60% thereof and the nonionic detergent will preferably contain at least 50% of such preferred poly-lower alkoxy higher alkanol.

The alkyl polysaccharides are surfactants which are also useful alone or in conjunction with the aforementioned surfactants and have those having a hydrophobic group containing from about 8 to about 20 carbon atoms, preferably from about 10 to about 16 carbon atoms, most preferably from 12 to 14 carbon atoms, and polysaccharide hydrophilic group containing from 1.5 to about 10, preferably from about 1.5 to 4, and most preferably from 1.6 to 2.7 saccharide units (e.g., galactoside, glucoside, fructoside, glucosyl, fructosyl, and/or galactosyl units). Mixtures of saccharide moieties may be used in the alkyl polysaccharide surfactants. The number x indicates the number of saccharide units in a particular alkyl polysaccharide surfactant. For a particular alkyl polysaccharide molecule x can only assume integral values. In any physical sample can be characterized by the average value of x and this average value can assume non-integral values. In this specification the values of x are to be understood to be average values. The hydrophobic group (R) can be attached at the 2-, 3-, or 4- positions rather than at the 1-position, (thus giving e.g. a glucosyl or galactosyl as opposed to a glucoside or galactoside). However, attachment through the 1-position, i.e., glucosides, galactosides, fructosides, etc., is preferred. In the preferred product the additional saccharide units are predominately attached to the previous saccharide unit's 2position. Attachment through the 3-, 4-, and 6-positions can also occur. Optionally and less desirably there can be a polyalkoxide chain joining the hydrophobic moiety (R) and the polysaccharide chain, the preferred alkoxide moiety is ethoxide.

Typical hydrophobic groups include alkyl groups, either saturated or unsaturated, branched or unbranched containing from about 8 to about 20, preferably from about 10 to about 16 carbon atoms. Preferably, the alkyl group is a straight chain saturated alkyl group. The alkyl group can contain up to 3 hydroxy groups and/or the polyalkoxide chain can contain up to about 30, preferably less than 10, most preferably 0, alkoxide moieties.

Suitable alkyl polysaccharides are decyl, dodecyl, tetradecyl, pentadecyl, hexadecyl, and octadecyl, di-, tri-, tetra-, penta-, and hexaglucosides, galactosides, lactosides, fructosides, fructosyls, lactosyls, glucosyls and/or galactosyls and mixtures thereof.

The alkyl monosaccharides are relatively less soluble in water than the higher alkyl polysaccharides. When used in admixture with alkyl polysaccharides, the alkyl monosaccharides are solubilized to some extent. The use of alkyl monosaccharides in admixture with alkyl polysaccharides is a preferred mode of carrying out the invention. Suitable mixtures include coconut alkyl, di-, tri-, tetra-, and pentaglucosides and tallow alkyl tetra-, penta-, and hexaglucosides.

The preferred alkyl polysaccharides are alkyl polyglucosides having the formula:

$$R_{20}O(C_nH_{2n}O)r(Z)_x$$

wherein Z is derived from glucose, R is a hydrophobic group selected from the group consisting of alkyl, alkylphenyl, hydroxyalkylphenyl, and mixtures thereof in which said alkyl groups contain from about 10 to about 18, preferably from 12 to 14 carbon atoms; n is 2 or 3 preferably 2, r is from 0 to about 10, preferable 0; and x is from 1.5 to about 8, preferably from 1.5 to 4, most preferably from 1.6 to 2.7. To prepare these compounds a long chain alcohol ($R^2OH$) can be reacted with glucose, in the presence of an acid catalyst to form the desired glucoside. Alternatively the alkylpolyglucosides can be prepared by a two step procedure in which a short chain alcohol ($R_1OH$) an be reacted with glucose, in the presence of an acid catalyst to form the desired glucoside. Alternatively the alkylpolyglucosides can be prepared by a two step procedure in which a short chain alcohol ($C_{1-6}$) is reacted with glucose or a polyglucoside (x=2 to 4) to yield a short chain alkyl glucoside (x=1 to 4) which can in turn be reacted with a longer chain alcohol ($R^2OH$) to displace the short chain alcohol and obtain the desired alkylpolyglucoside. If this two step procedure is used, the short chain alkylglucoside content of the final alkylpolyglucoside material should be less than 50%, preferably less than 10%, more preferably less than 5%, most preferably 0% of the alkylpolyglucoside.

The amount of unreacted alcohol (the free fatty alcohol content) in the desired alkylpolysaccharide surfactant is preferably less than about 2%, more preferably less than about 0.5% by weight of the total of the alkylpolysaccharide. For some uses it is desirable to have the alkyl monosaccharide content less than about 10%.

The used herein, "alkyl polysaccharide surfactant" is intended to represent both the preferred glucose and galactose derived surfactants and the less preferred alkyl polysaccharide surfactants. Throughout this specification, "alkyl polyglucoside" is used to include alkyl- polyglycosides because the stereo chemistry of the saccharide moiety is changed during the preparation reaction.

An especially preferred APG glycoside surfactant is APG 625 glycoside manufactured by the Henkel Corporation of Ambler, PA. APG 25 is a nonionic alkyl polyglycoside characterized by the formula:

$C_nH_{2n+1}O(C_6H_{10}O_5)_xH$ wherein n=10(2%); n=12(65%); n=14(21–28%); n=16(4–8%) and n=18 x(degree of polymerization)=1.6. APG 625 has: a pH of 6–8(10% of APG 625 in distilled water); a specific gravity at 25° C. of 1.1 grams/ml; a density at 25° C. of 9.1 kgs/gallons; a calculated HLB of about 12.1 and a Brookfield viscosity at 35° C., 21 spindle, 5–10 RPM of about 3,000 to about 7,000 cps. Mixtures of two or more of the liquid nonionic surfactants can be used and in some cases advantages can be obtained by the use of such mixtures.

The liquid nonaqueous nonionic surfactant is absorbed on a builder system which comprises a mixture of phosphate-free particles which is a builder salt and a low molecular weight polyacrylate type polymer such as a polyacrylate organic and/or inorganic detergent builders. A preferred solid builder salt is an alkali carbonate such as sodium carbonate or an alkali metal citrate sodium citrate or a mixture of sodium carbonate and sodium citrate. When a mixture of sodium carbonate and sodium citrate is used, a weight ratio of sodium citrate to sodium carbonate is about 9:1 to about 1:9, more preferably about 3:1 to about 1:3.

Other builder salts which can be mixed with the sodium carbonate and/or sodium citrate are gluconates, phosphonates and nitriloacetic acid salts. In conjunction with the alkali metal builder salts is used a mixture of low molecular weight polyacrylates polymers having a molecular weight of about 1,000 to about 20,000, more preferably about 2,000 to about 10,000. One of the lower molecular weight polyacrylates of the mixture is a homopolymer of polyacrylates Good Rite K759 manufactured by and having a molecular weight of about 2100. The other low molecular weight polyacrylates is Acusol 460 manufactured by Rohm and Haas and having a molecular weight of about 15,000. The Acusol 460 is a copolymer of a polyacrylate and maleic anhydride.

In place of the Acusol 460 can be used Sokalan™CP45 which is a copolymer of an acrylic acid and an acid anhydride having a molecular weight of about 70,000. Such a material should have a water absorption at 380C and 78 percent relative humidity of less than about 40 percent and preferably less than about 30 percent. The builder is commercially available under the tradename of Sokalan™CP45. This is a partially neutralized copolymer of polyacrylic acid and maleic anhydride sodium salt. Another class of builders useful herein at a concentration of 0 to about 20 weight percent, more preferably about 0.5 to about 20.0 weight percent are the aluminosilicates, both of the crystalline and amorphous type. Various crystalline zeolites (i.e. aluminosilicates) are described in British Patent No. 1,504,168, U.S. Pat. No. 4,409,136 and Canadian Patent Nos. 1,072,835 and 1,087,477. An example of amorphous zeolites useful herein can be found in Belgium Patent No. 835,351. The zeolites generally have the formula $(M_2O)_x(Al_2O_3)_y(SiO_2)_zwH_2O$ wherein x is 1, y is from 0.8 to 1.2 and preferably 1, z is from 1.5 to 3.5 or higher and preferably 2 to 3 and w is from 0 to 9, preferably 2.5 to 6 and M is preferably sodium. A typical zeolite is type A or similar structure, with type 4A particularly preferred. The preferred aluminosilicates have calcium ion exchange capacities of about 200 milliequivalents per gram or greater, e.g. 400 meq/g.

The alkali metal silicates are useful anti-corrosion agents which function to make the composition anti-corrosive to eating utensils and to automatic dishwashing machine parts. Sodium silicates of $Na_2O/SiO_2$ ratios of from 1:1 to 1:3.4, more preferably 1:1 to 1:2.8. Potassium silicates of the same ratios can also be used. The preferred silicates are sodium disilicate (anhydrous), sodium disilicate (hydrated) and sodium metasilicate and mixtures thereof, wherein the preferred silicate is a hydrated alkali metal disilicate.

Essentially, any compatible anti-foaming agent can be used. Preferred anti-foaming agents are silicone anti-foaming agents. These are alkylated polysiloxanes and include polydimethyl siloxanes, polydiethyl siloxanes, polydibutyl siloxanes, phenyl methyl siloxanes, dimethyl silinated silica, trimethysilanated silica and triethylsilanated silica. A suitable anti-foaming agent is Silicone SAG 1000 from Union Carbide. Other suitable anti-foaming agents are Silicone DB700 used at about 0 to about 1.0 percent by weight, more preferable 0.05 to 1.0 percent by weight sodium stearate used at a concentration level of about 0 to 1.0 weight percent and 1.0 weight percent, more preferably 0.1 to 1.0 percent by weight and LPKN 158 (phosphoric ester) sold by Hoechst used at a concentration level of about 0 to about 1.5 weight percent, more preferably about 0.05 to about 0.5 weight percent. The perfumes that can be used include lemon perfume and other natural scents. Essentially, any opacifier that is compatible with the remaining components of the detergent formulation can be used. A useful and preferred opacifier is titanium dioxide at a concentration level of about 0 to about 1.0 weight percent.

A key aspect is to keep the free water (non-chemically bonded water) in the detergent composition at a minimum. Absorbed and adsorbed water are two types of free water, and comprise the usual free water found in a detergent composition. Free water will have the affect of deactivating the enzymes. It will also serve to solubilize the available $Na_2O$ and thus increase the alkalinity of the detergent composition. The composition can contain about 0 to 50% wt. %, more preferably 5 to 45 wt. % of an alkali metal sulfate filler such as sodium sulfate.

The detergent compositions of the present invention can include a peroxygen bleaching agent at a concentration level of about 0.1 to about 20.0 weight percent, more preferably about 0.5 to about 17 weight percent and most preferably at about 1.0 to about 14 weight percent. The oxygen bleaching agents that can be used are alkali metal perborate, percarbonate, perphthalic acid, perphosphates, and potassium monopersulfate. A preferred compound is sodium perborate monohydrate. The peroxygen bleaching compound is preferably used in admixture with an activator at a concentration level of 0 to about 5 wt. percent, more preferably about 0.1 to about 5 wt. percent. Suitable activators are those disclosed in U.S. Pat. No. 4,264,466 or in column 1 of U.S. Pat. No. 4,430,244, both of which are herein incorporated by reference. Polyacetylated compounds are preferred activators. Suitable preferred activators are tetra acetyl ethylene diamine ("TAED"), pentaacetyl glucose and ethylidenebenzoate acetate. The activator usually interacts with the peroxygen compound to form a peroxyacid bleaching agent in the wash water. The detergent formulation also contains a mixture of a proteolytic enzyme and an amylotytic enzyme and, optionally, a lipolytic enzyme that serve to attack and remove organic residues on glasses, plates, pots, pans and eating utensils. Proteolytic enzymes attack protein residues, lipolytic enzymes fat residues and amylolytic enzymes starches. Proteolytic enzymes include the protease enzymes subtilism, bromelin, papain, trypsin and pepsin. Amylolytic enzymes include amylase enzymes. Lipolytic enzymes include the lipase enzymes. The preferred amylase enzyme is available under the name Maxamyl, derived from Bacillus licheniformis and is available from Gist-Brocades of the Netherlands available in the form of a prill having an activity of about 6,000 TAU/g. The preferred protease enzyme is available under the names Maxapem 15, Maxapem 30 or Maxapem 42 which are high alkaline mutant proteolytic enzyme derived from Bacillus alcalophylus, and is supplied by from Gist-Brocades, of the Netherlands in a prill form (activity of about 30MPU in the case of Maxapem 30. Preferred enzyme activates per wash are Maxapem 15 or 42 of 10–160 MPU per wash or Maxapem 30 of 5–200 MPU per wash, and Maxamyl-2,000–8,000 TAU per wash, wherein the Maxapem 15,30 or 42 exhibits improved resistance to activated oxygen (perborate) agents which can be used in the instant composition. Another less preferred protease enzyme is available under the name Maxatase derived from a novel Bacillus strain designated "PB92" wherein a culture of the Bacillus is deposited with the Laboratory for Microbiology of the Technical University of Delft and has a number OR-60, and is supplied by from Gist-Brocades, of the Netherlands in a prill form (activity of about 40,000 DU/g.). Preferred enzyme activates per wash are Maxatase 250–600 KDU per wash and Maxamyl-4,000–8,000 TAU per wash. Another preferred protease enzyme is available under the name Maxacal and is supplied by Gist-brocades, of the Netherlands in a prill form (activity of about 329KADU/g.). Preferred enzyme activates per wash are Maxacal 300–700 KADU per wash and Maxamyl-2,000 to 4,000 TAU per wash.

Another useful amylase enzyme sold by Novo is Termamyl 300 1 Dx having an activity of 300 KNU/g. It is an alphaamylase prepared by submerged fermentation of a selected strain of Bacillus liceniformis. Another useful protease enzyme is Savinase 16.0L Type, Ex sold by Novo. It has an actively of 16.KNPU/g and is prepared by submerged fermentation of an alcalophilic strain of Bacillus. Another useful protease enzyme is durazym 16.0 L Type Ex which is sold by Novo and has an activity of 16DPU/g. It is a protein-engineered variant of Savinase.

The weight ratio of the proteolytic enzyme to the amylolytic enzyme in prill form the powdered automatic dishwasher detergent compositions is about 6:1 to about 1:1, and more preferably about 4.5:1 to about 1.1:1.

The detergent composition can have a fairly wide ranging composition. The surfactant can comprise about 0 to 15 percent by weight of the composition, more preferably about 0.1 to 15 percent by weight, and most preferably about 0.5 to about 12 percent by weight. The anti-foaming agent will be present in an amount of about 0 to about 1.5 percent by weight, more preferably about 0.05 to about 1.2 percent by weight and most preferably about 0.05 to about 1 percent by weight. The builder system is present in an amount of about 2 to about 40 percent by weight, more preferably about 4 to about 40 percent by weight and most preferably about 10 to about 40 percent by weight. The builder system contains a low molecular weight polyacrylate homopolymer polymer at a concentration level of about 0 to about 20 weight percent, more preferably 1.0 to about 10 weight percent and most preferably about 2 to about 8 weight percent and a low molecular weight copolymer of an acrylate and olefin or a copolymer of an acrylate and maleic anhydride at a concentration of about 0 to 8 wt.% more preferably 0.5 to 6 wt. % and most preferably 1 to 5 wt. % and 5 to 35 wt. percent of at least one alkali metal phosphate free builder salt. The composition also includes the peroxygen bleaching agent at a concentration of about 0 to 20 wt. percent and the activator at a concentration of about 1 to 5 wt. percent.

The alkali silicate, which is a corrosion inhibitor, wherein sodium disilicate is preferred, will be present in an amount of about 0 to 50 percent by weight, more preferably about 3 to about 50 percent by weight and most preferably about 4 to about 45 percent by weight.

The opacifier will be present in an amount of about 0 to about 1.0 percent by weight, more preferably about 0.1 to about 0.7 percent by weight and most preferably about 0.4 percent by weight.

The enzymes will be present in an amount in a prill form as supplied by GistBrocades at a concentration of about 0.8 to 22.0 percent by weight, more preferably about 0.9 to 20.0 percent by weight, and most preferably about 1.0 to about 18.0 percent by weight. The protease enzyme prills in the automatic dishwashing composition will comprise about 0.5 to about 15.00 percent by weight, more preferably about 0.7 to about 13.0 weight percent and most preferably about 0.8 to about 11.0 percent by weight. The amylase enzyme prills will comprise about 0.3 to about 8.0 percent by weight, more preferably about 0.4 percent to about 7.0 weight percent and most preferably about 0.5 to about 6.0 weight percent. The lipase enzyme will comprise about 0.00 to about 8.0 percent by weight of the detergent composition. A typical lipase enzyme is Lipolase 100 T from Novo Corporation. The lipase enzymes are especially beneficial in reducing grease residues and related filming problems on glasses and dishware. Another useful lipase enzyme is Amano PS lipase provided by Amano International Enzyme Co., Inc.

Other components such as perfumes will comprise about 0. 1 to about 5.0 percent by weight of the detergent composition.

One method for forming the free flowing powdered dishwashing composition of the instant invention having improved enzyme stability and having a density of about 0.75 to about 1.0 ky/liter, more preferably about 0.80 to about 0.95 ky/liter comprises the formation by mixing a physical blend of agglomerated beads and a blend portion of the balance of the ingredients of the composition which are not contained in the agglomerated beads. The agglomerated beads are formed in a rotary type drum agglomerater from O'Brien industrial Equipment Co. The nonionic surfactant is sprayed at about 100° F. to 160° F. at a rate of about 2–10 lbs/minute onto the alkaline metal compounds contained into the rotary drum. The resultant agglomerated beads are dried in a fluid Bed dryer at about 80° F. such that the water content is less than 8.0 wt. % and caking of the beads is minimized. If necessary, the agglomerated beads can be passed through a stoke granulation. The blend portion is prepared at about room temperature in a suitable dry blending apparatus such as a tumble or rotary mixer. The physical mixture of the agglomerated beads and the blend portion are mixed together at about room temperature in any suitable mixer such as a rotary or tumble mixer.

The agglomerated beads have a maximum particle size of less than about 2000 microns, more preferably less than 1750 microns. The agglomerated beads comprise a core having at less one coating deposited and absorbed on the particles that form the core. The core comprises a mixture of at least one alkali metal detergent builder salt and optionally an alkali metal silicate, a low molecular weight noncrosslinked polyacrylate homopolymer, a low molecular weight noncrosslinked copolymer of acrylate and an olefin or a copolymer of acrylate and maleic anhydride and/or an alkali metal perborate. When the core includes both the polyacrylate homopolymer and the polyacrylate copolymer and the alkali metal silicate, the coating comprises the nonionic surfactant and optionally, the anti-foaming agent. When the core does not include the polyacrylate homopolymer and the polyacrylate copolymer, the coating comprises a mixture of the polyacrylate homopolymer, the polyacrylate copolymer and the nonionic surfactant and optionally the anti-foaming agent. When the core does not include the alkali metal silicate but does include the polyacrylate homopolymer, and the polyacrylate copolymer, the beads are formed from a first coating of the nonionic surfactant coating absorbed on the core and a second coating of the alkali metal silicate deposited on the nonionic surfactant coating. The alkali metal perborate can be optionally included in the core of the agglomerated beads or in the alternative constitute one of the ingredients of the blend portion of the composition which is mixed with the agglomerated beads. The blend portion of the composition comprises at least one protease enzyme and an amylase enzyme and optionally, the anti-foaming agent, the alkali metal perborate, the alkali metal perborate activator, fragrance colorant and an aluminosilicate as well as fillers or extenders such as an alkali metal sulfates. Alternatively, the aluminosilicate and the alkali metal sulfates can form a portion of the core of the agglomerated beads. The blend portion has a maximum particle size of less than 2000 microns, more preferably 1750 microns.

The most preferred composition comprise those in which the core of the agglomerated beads include the alkali metal detergent builder salts and the alkali metal silicates. It is a well known and established fact that the activity and storage life or an enzyme is decreased by contact with alkaline type compounds. When the alkaline metal detergent builder and the alkali metal silicate are contained within the agglomerated beads they are physically separated from the enzymes which are contained in the blend portion thereby minimizing chemical contact between the enzymes and the alkaline metal detergent builder salt and alkali metal silicate. The nonionic sudactant coating functions as a further barrier to minimize contact of the enzymes with the alkaline compounds.

The instant compositions also can be produced as low density powders according to the procedure as set forth in U.S. Pat. No. 4,931,203 which is hereby incorporated by reference, wherein these powders have a bulk density less than the bulk density of about ⅓ of the bulk density the standard powders such as about 0.55 to about 07 kg/liter.

A preferred free flowing powdered composition having improved enzyme stability of the instant invention comprises approximately by weight:

(a) 2 to 40 wt. percent of a phosphate free builder salt selected from the group consisting essentially of an alkali metal carbonates and an alkali metal citrates and mixtures thereof;

(b) 1 to 10 percent of a low molecular weight non crosslinked polyacrylate homopolymer;

(c) 0.5 to 6 wt. % of a low molecular weight non crosslinked copolymer of acrylate and an olefin;

(d) 0 to 30.0 percent of an alkali metal silicate;

(e) 1 to 12 percent of a liquid nonionic surfactant;

(f) 0 to 1.5 percent of an anti-foaming agent;

(g) 5 to 45% of an alkali metal sulfate;

(h) 0.5 to 15.0 percent of at least one protease enzymes; and (i) 0.3 to 8.0 percent of an amylase enzyme, wherein the individual particles of the composition having a maximum particle size of less than about 2000 microns and the composition has less than 8.0 wt. percent of water therein.

It is essential that the free flowing individual particles of the instant composition have a particle size of less than about 2,000 microns and that the individual powder particles are not agglomerated which would occur if the composition contains 8.0 wt. % or more of water. It is also critical that 15 wt. percent of less of the nonionic surfactant be used because higher used amounts of the nonionic surfactant will cause the formation of large lumps of the powder particles and thereby destroying the free flowing characteristics of the powdered composition. Additionally, the employment of more than 15.0 weight percent of the surfactant will cause excess foaming in the automatic dishwasher and the propeller blades will be impeded.

The composition of the instant invention specifically do not contain a clay such as a layered clay like Laponite or Bentonite. The presence of clays in the instant compositions will have an adverse effect on the cleaning performance of the composition by increasing spotting on the glassware being cleaned in the automatic dishwasher with a .clay containing composition as compared to a non clay containing composition.

The concentrated powdered nonionic automatic dishwashing detergent compositions of the present invention disperses readily in the water in the dishwashing machine. The presently used home dishwashing machines have a measured capacity for about 80 cc or 90 grams of detergent. In normal use, for example, for a full load of dirty dishes 60 grams of powdered detergent are normally used.

In accordance with the present invention only about 19 cc or about 15 grams of the concentrated powdered detergent composition is needed. The normal operation of an automatic dishwashing machine can involve the following steps or cycles: washing, rinse cycles with cold water and rinse cycles with hot water. The entire wash and rinse cycles require about 60 minutes. The temperature of the wash water is about 40° C. to about 65° C. and the temperature of the rinse water is about 55° C. to about 65° C. The wash and rinse cycles use about 4 to 7.5 liters of water for the wash cycle and about 4 to 7.5 liters of water for the hot rinse cycle.

The highly concentrated powdered automatic dishwashing detergent compositions exhibit excellent cleaning properties and because of the high concentration of the detergent in the composition, the detergent is not totally consumed during the wash cycle or totally eliminated during the rinse cycle such that there is a sufficient amount of detergent remaining during the rinse cycle to substantially improve the rinsing. The washed and dried dishes are free of undesirable traces, deposits or film due to the use of hard water in the rinse cycle.

DETAILED DESCRIPTION OF THE PREFERRED EMBODIMENTS

The following formulas are in weight percents unless otherwise specified.

EXAMPLE 1

The concentrated powdered nonionic detergent compositions were formulated from the following ingredients in the amounts specified according to the previously defined and described dry blending process.

TABLE 1

| RAW MATERIALS | A | B | C | D | E | F |
|---|---|---|---|---|---|---|
| Anhydrous Sodium Metasilicate | 23 | 23 | 23 | 23 | — | — |
| Sodium Disilicate (at 22% water) | — | — | — | — | 32.6 | 46.7 |
| Nonionic A coated Maxacal at 330 KADU/g | — | 8.0 | 16.0 | — | — | — |
| Nonionic coated Maxamyl at 5800 TAU/g | — | — | — | 6.9 | 5 | — |
| PEG Coated Maxamyl at 5900 TAU/g | — | — | — | — | — | — |
| PEG Coated Maxapem CX 30 at 600 KADU/g | — | — | — | — | 6.5 | 3 |
| SOKALAN CP45 at 6% water from BASF | 10 | 10 | 10 | 10 | 10 | 10 |
| Soda Ash | 34.2 | 34.2 | 34.2 | 34.2 | 26 | 12.07 |
| Sodium Citrate Dehydrated | — | — | — | — | — | 15.7 |
| TAED | — | — | — | — | 3 | 2.0 |
| Silicone DB1000 | 0.5 | 0.5 | 0.5 | 0.5 | 3 | 2.0 |
| Synperonic LFD25 | 4.5 | 4.5 | 4.5 | 4.5 | 4.9 | 1.3 |
| Sodium Perborate Monohydrated | 10 | 10 | 10 | 10 | 10 | 6.7 |
| Caustic Soda | — | — | — | — | 1.9 | — |
| CP Perfume (Vertia) | — | — | — | — | — | 0.1 |

EXAMPLE 2

Formulas (A–E) of Example 1 were tested in a European style Philips 664 Dishwasher working at 55° C. with a charge of 15.0 grams per wash of the Formulas (A–E) and 3 mi./per wash of commercial Galaxy rinse aid sold by Colgate-Palmolive Co., said rinse aid being automatically dispersed by a built in closing device during the last rinse cycle. Each formulation was evaluated according to Table II by using a 0 to 10 scale with the higher number, being the better result.

TABLE II

| Soil Removal | A | B | C | D | E | F |
|---|---|---|---|---|---|---|
| Oatmeal | 7 | 7.5 | 8.5 | 10 | 10 | 10 |
| Microeggs | 5 | 7.5 | 9 | 5 | 7.3 | 8.2 |
| Calcium Eggs | 2 | 9 | 9.5 | 2 | 10 | 9.8 |
| Filming | — | — | — | — | 7.0 | 7.8 |
| Spotting | — | — | — | — | 7.3 | 5.9 |
| Glass Day Light | — | — | — | — | 9.0 | 6.7 |
| Tea Stain | — | — | — | — | — | — |
| Greasy Buildup on Strainer | — | — | — | — | — | 8.8 |
| Greasy Buildup | | | | | | |
| Spotting | — | — | — | — | 7.5 | 6.4 |
| Filming | — | — | — | — | 7.1 | 8.2 |
| Glass Day Light | — | — | — | — | 9.5 | 6.9 |
| Greasy Buildup on Strainer | — | — | — | — | 9.0 | 7.8 |

The above described examples of illustrative compositions of the invention were evaluated for performance according to the following laboratory test methods.

In the so called soil removal, each dishwasher is loaded with three cups soiled with tea, six plates soiled with parridge oats, three plates soiled with hardened eggs and three plates soiled with microwave oven cooked eggs.

The cup staining was obtained by using 3 cups previously filled with a 5% fluorhydric acid solution during 15 minutes in order to remove the overglaze protection. The cups were washed and dried just before staining. The tea stain was prepared by adding 90 ml boiling water to one 2g dose of LIPTON yellow label tea and leaving the system at rest for 20 minutes. After emptying, the cups were then allowed to dry for 24 hours.

Oatmeal soil was prepared by boiling 24 grams of Quaker oats in 400 ml of tap water for ten minutes and then homogenizing with a high shearing device (Ultratwax). Three grams of this mixture was spread as thin film onto 7.5 inch china plates. The plates were aged for 2 hours at 80° C., and then stored overnight at room temperature. Hardened egg soil was prepared by mixing thirty grams of egg yolk with an equal amount of 2.5 calcium chloride solution. 0.4 grams of this mixture was applied as a thin crosswise film to the usable surface of 7.5 inch china plates. Microwave-egg soil was prepared by mixing thirty grams of hot egg yolk and fifty grams of cooked margarine with a homogenizer (Ultraturax device), and heating the resultant mixture by steam for three minutes. Five grams of this mixture were spread as thin film onto 7.5 inch china plates, and the soiled plates were baked afterwards for one minute in a microwave oven. The two type of egg soils were stored overnight at room temperature. Six plates of oatmeal, 3 cups soiled with tea, and three plates of each egg were used per wash, together with six clean glasses. The twelve soiled plates, the three soiled cups, and the six glasses were always placed in the same positions in the dishwasher at each run. In each test four different compositions were assessed using a series of four dishwashers. All washed plates were scored each run by determining the percent area cleaned (percentage of soil removal) with the aid of a reference scale of gradually cleaned plates. Average percentages of soil removal for each type of soil after four runs were converted in a 0 to 10 scale, 0 being for no soil removal and 10 for perfect cleaning. Glasses were rated in a viewing box for filming and spotting and under natural lighting for global evaluation. They were rated according to a scale ranging from 0 (bad performance) to 10 (perfectly clean glasses) with the aid of reference glasses.

In the greasy residue build-up test, the dishwasher load included six clean plates in the lower basket and six clean glasses in the upper basket. The soil load was consisting of 100 grams of a greasy soil mixture prepared by mixing mustard (42 weight %) white vinegar (33 wt. %), corn oil (15 wt. %), and lard (10 wt. %) altogether. The 100 grains soil load and the 15.0 grams of the detergent composition were then introduced at the same time at the dispense cup opening into the machine.

After each cycle, glasses were scored in a viewing box for filming and spotting and under natural lighting for 966d aspect according to the same 0 (bad performance) to 10 (perfectly clean glasses) scale as for the so-called soil removal test with the aid of reference glasses.

In some washing performance evaluation, the dishwasher filter parts were also visually assessed and rated by a trained appraiser according to a scale of 0 to 10 (10 means no grease deposit) to evidence greasy deposit build up differences between compositions.

EXAMPLES 3–4

The concentrated powdered nonionic surfactant detergent compositions were formulated from the following ingredients in the amounts specified according to the previously defined and described in the dry blending process.

TABLE III

| RAW MATERIALS | FORMULA COMPOSITIONS (IN PARTS) | | | | | | |
|---|---|---|---|---|---|---|---|
| | A | B | C | D | E | F | G |
| Anhydrous Sodium Metasilicate | 23 | 23 | 23 | 23 | — | — | — |
| Sodium Disilicate (at 22% water) | — | — | — | — | 23 | 23 | 23 |
| Nonionic coated Maxcal at 330 KADU/g | — | 8.0 | 16.0 | — | — | — | — |
| Nonionic coated Maxamyl at 5800 TAU/g | — | — | — | — | 6.9 | 6.9 | 11 |
| Nonionic coated Maxatase at 440 KDU/g | — | — | — | — | 10.9 | 10.9 | 7 |
| PEG coated Maxacal at 350 KADU/g | — | — | — | — | — | — | — |
| PEG coated Maxamyl at 5900 TAU/g | — | — | — | — | — | — | — |
| | A | B | C | D | E | F | G |
| PEG coated Maxapem CX30 at 600 KADU/g | — | — | — | — | — | — | — |
| SOKALAN CP45 at 60% water from BASF | 10 | 10 | 10 | 10 | 10 | 10 | 10 |
| Soda Ash | 34.2 | 34.2 | 34.2 | 34.2 | 34.2 | 29.2 | 29 |
| Sodium Citrate Dihydrated | — | — | — | — | — | — | — |
| TAED | — | — | — | — | — | — | — |
| Silicone DB100 | 0.5 | 0.5 | 0.5 | 0.5 | 0.5 | 0.5 | 0.5 |
| Synperonic LFD25 | 4.5 | 4.5 | 4.5 | 4.5 | 4.5 | 4.5 | 4.5 |
| Sodium Perbrate Monohydrated | 10 | 10 | 10 | 10 | 10 | 10 | 10 |
| Caustic Soda | — | — | — | — | — | 5 | 5 |
| Lipolase 100T (NOVO) | — | — | — | — | — | — | — |

| RAW MATERIALS | FORMULA COMPOSITIONS (IN PARTS) | | | | | | |
|---|---|---|---|---|---|---|---|
| | H | I | J | K | L | M | N |
| Anhydrous Sodium Metasilicate | — | — | — | — | — | — | — |
| Sodium Disilicate (at 22% water) | 23 | 23 | 23 | 23 | 23 | 23 | 23 |
| Nonionic coated Maxcal at 330 KADU/g | — | — | — | — | — | — | — |
| Nonionic coated Maxamyl at 5800 TAU/g | 5 | 5 | 3 | 3 | 3 | 5 | 5 |
| Nonionic coated Maxatase at 440 KDU/g | 13 | 13 | 15 | 15 | 15 | 13 | 13 |
| PEG coated Maxacal at 350 KADU/g | — | — | — | — | — | — | — |
| PEG coated Maxamyl at 5900 TAU/g | — | — | — | — | — | — | — |

TABLE IV

| | H | I | J | K | L | M | N |
|---|---|---|---|---|---|---|---|
| PEG coated Maxapem CX30 at 600 KADU/g | — | — | — | — | — | — | — |
| SOKALAN CP45 at 60% water from BASF | 10 | 10 | 10 | 10 | 5 | 10 | 10 |
| Soda Ash | 29 | 26 | 28.2 5 | 22.7 5 | 31 | 26 | 26 |
| Sodium Chlorate Dehydrated | — | — | — | — | — | — | — |
| TAED | — | 3 | 3 | 3 | 3 | 3 | 3 |
| Silicone DB100 | 0.5 | 0.5 | 0.25 | 0.75 | 0.5 | 0.5 | 0.5 |
| Synperonic LFD25 | 4.5 | 4.5 | 2.5 | 7.5 | 4.5 | 4.5 | 4.5 |
| Sodium Perbrate Monohydrated | 10 | 10 | 10 | 10 | 10 | 10 | 10 |
| Caustic Soda | 5 | 5 | 5 | 5 | 5 | 1.9 | 1.9 |
| Clipolase 100T (NOVO) | — | — | — | — | — | — | 1 |

TABLE IV-continued

| TEST | Cleaning Performance Evaluations (at 55° C.) | | | | | | |
|---|---|---|---|---|---|---|---|
| Soil Removal | A | B | C | D | E | F | G |
| Oatmeal | 7 | 7.5 | 8.5 | 10 | 10 | 10 | 10 |
| Microeggs | 5 | 7.5 | 9 | 5 | 7.0 | 7.4 | 7.2 |
| Calcium Eggs | 2 | 9 | 9.5 | 2 | 8.8 | 9.1 | 8.9 |
| Filming | — | — | — | — | 7.5 | 7.6 | 7.8 |
| Glass Daylight | — | — | — | — | — | — | — |
| Tea Stain | — | — | — | — | — | — | — |
| Greasy Buildup on Strainer | — | — | — | — | — | — | — |
| Greasy Buildup | | | | | | | |
| Spotting | — | — | — | — | — | — | — |
| Filming | — | — | — | — | — | — | — |
| Glass Daylight | — | — | — | — | — | — | — |

| TEST | Cleaning Performance Evaluations (at 55° C.) | | | | | | |
|---|---|---|---|---|---|---|---|
| Soil Removal | H | I | J | K | L | M | N |
| Oatmeal | 10 | 10 | 10 | 10 | 10 | 10 | 10 |
| Microeggs | 7.5 | 7 | 7.8 | 7.8 | 7.8 | 6.2 | 6.8 |
| Calcium Eggs | 10 | 10 | 10 | 10 | 10 | 10 | 9.8 |
| Filming | 7.8 | 7.7 | 6.7 | 7.8 | 6.5 | 7.4 | 8.2 |
| Spotting | 7.7 | 7.8 | 6.3 | 8.2 | 7.3 | 7.8 | 9.0 |
| Glass Daylight | — | — | — | — | — | 8.8 | 9.7 |
| Tea Stain | 5 | 9 | — | — | — | — | — |
| Greasy Buildup on Strainer | — | — | — | — | — | 9 | 5 |
| Greasy Buildup | | | | | | | |
| Spotting | — | — | — | — | — | 7.1 | 8.3 |
| Filming | — | — | — | — | — | 7.4 | 7.7 |
| Glass Day light | — | — | — | — | — | 8.1 | 9.3 |
| Greasy Buildup on Strainer | — | — | — | — | — | 8.0 | 1.3 |

The above described examples of illustrative compositions of the invention were evaluated for performance according to the test procedure of Example 2.

EXAMPLE V

The concentrated powdered nonionic surfactant detergent composition is formulated from the following ingredients in the amounts specified according to the previously defined and described dry blending process.

TABLE V

| RAW MATERIALS | FORMULA COMPOSITIONS (IN PARTS) | | | | | | | | |
|---|---|---|---|---|---|---|---|---|---|
| | A | B | C | D | E | F | G | H | I |
| Metasilicate Sodium | 23 | 23 | 23 | 23 | 23 | 23 | — | — | — |
| Sodium Disilicate (at 22% water) | — | — | — | — | — | — | 33 | 33 | 33 |
| Nonionic coated Maxcal at 330 KADU/g | — | 8.0 | 16.0 | — | 10.9 | 10.9 | — | — | — |
| Nonionic coated Maxamyl at 5800 TAU/g | — | — | — | 6.9 | 6.9 | 6.9 | — | — | — |
| Nonionic coated Maxatase at 440 KDU/g | — | — | — | — | — | — | — | — | — |
| PEG coated Maxacal at 350 KADU/g | — | — | — | — | — | — | 13 | 13 | 13 |
| PEG coated Maxamyl at 5900 TAU/g | — | — | — | — | — | — | 5 | 5 | 5 |
| PEG coated Maxapem CX30 at 600 KADU/g | — | — | — | — | — | — | — | — | — |
| SOKALAN CP45 at 60% water from BASF | 10 | 10 | 10 | 10 | 10 | 10 | 10 | 10 | 15 |
| Soda Ash | 34.2 | 34.2 | 34.2 | 34.2 | 34.2 | 34.2 | 10 | 10 | 10 |
| Sodium Citrate Dehydrated | — | — | — | — | — | — | 11 | 11 | 6 |
| TAED | — | — | — | — | — | — | 3 | — | 3 |
| Silicone DB100 | 0.5 | 0.5 | 0.5 | 0.5 | 0.5 | 0.5 | 0.5 | 0.5 | 0.5 |
| Synperonic LFDU5 | 4.5 | 4.5 | 4.5 | 4.5 | 4.5 | 4.5 | 0.5 | 0.5 | 0.5 |
| Sodium Perbrate | 10 | 10 | 10 | 10 | 10 | 10 | 10 | 10 | 10 |

TABLE V-continued

| RAW MATERIALS | FORMULA COMPOSITIONS (IN PARTS) | | | | | | | | |
|---|---|---|---|---|---|---|---|---|---|
| | A | B | C | D | E | F | G | H | I |
| Monohydrated Caustic Soda | — | — | — | — | — | 9 | — | — | — |
| Lipolase 100T (NOVO) | — | — | — | — | — | — | — | — | — |

EXAMPLE VI

Formulas (A–I) of Example 5 were tested in a European style Philips 664 Dishwasher working at 55° C. with a charge of 15.0 grams per wash of the Formulas (A–I) and 3 mi./per wash or commercial Galaxy rinse aid sold by Colgate-Palmolive Co. The load of items placed in the dishwasher consisted of 6 plates soiled with 3.0 grams of a mixture of 12.0 grams of porridge oats with 188 grams of water and 3 plates soiled with 0.4 grams of calcium chloride denaturated egg yolk and three plates soiled with 5 grams of a microwave oven baked mixture of 177 grams of egg yolk with 50 grams of margarine and 3 cups soiled with tea after overglaze removal wherein all the plates and cups were dried prior to being placed in the dishwasher. The pH of the washing bath and the formulation were measured. The hardness of the rinse water was 38 ($C_aCO_3$) ppm. Each formulation was evaluated for spotting and filming. The results were evaluated on a scale of 1 to 10 with the higher number being the better results.

TABLE VI

| TEST | Cleaning Performance Evaluations (at 55° C.) | | | | | | | | |
|---|---|---|---|---|---|---|---|---|---|
| Soil Removal | A | B | C | D | E | F | G | | |
| Oatmeal | 7 | 7.5 | 8.5 | 10 | 10 | 10 | 10 | 10 | 10 |
| Microeggs | 5 | 7.5 | 9 | 5 | 7.5 | 9 | 8.8 | 8.2 | 9.0 |
| Calcium Eggs | 2 | 9 | 9.5 | 2 | 9.3 | 9 | 9.7 | 9.7 | 10 |
| Filming | — | — | — | — | 7.6 | 7.5 | 7.3 | 7.6 | 7.5 |
| Spotting | — | — | — | — | 6.0 | 7.5 | 6.3 | 8.2 | 7.5 |
| Glass Daylight | — | — | — | — | — | — | 8.3 | 9.2 | 8.7 |
| Tea Stain | — | — | — | — | — | — | 10 | 6 | 10 |
| Greasy Buildup on Strainer | — | — | — | — | 9 | 5 | 9 | 7 | 8 |
| Greasy Buildup | | | | | | | | | |
| Spotting | — | — | — | — | — | — | 8.5 | 7.2 | 8.2 |
| Filming | — | — | — | — | — | — | 7.7 | 7.5 | 7.3 |
| Glass Daylight | — | — | — | — | — | — | 8.5 | 8.5 | 9.8 |
| Greasy Buildup on Strainer | — | — | — | — | — | — | 9.0 | 9.0 | 9.0 |

EXAMPLE 8

The following formulas were prepared according to the procedure of Example 1.

TABLE VII

| | A | B |
|---|---|---|
| Disilicate | 31.77 | 29.42 |
| Sodium Tripolyphosphate | 51.0 | 47.22 |
| Perborate | 6.7 | 6.2 |
| LFD25 | 1.3 | 1.2 |
| SAG 1000 | 0.13 | 0.12 |
| Maxamyl | 3.0 | 2.78 |
| Maxatase | 4.0 | 3.7 |
| TAED | 2.0 | 1.85 |
| Perfume | 0.1 | 0.09 |
| Water | — | 8.0 |
| Appearance | Fine powder | Large lumps |

TABLE VII-continued

| | C | D |
|---|---|---|
| Disilicate | 38.7 | 35.83 |
| Sodium citrate | 13.0 | 12.04 |
| Sokalan CP5 | 15.0 | 13.89 |
| Na2CO3 | 10.0 | 9.26 |
| TAED | 3.0 | 2.78 |
| Perborate | 10.0 | 9.26 |
| LFD25 | 2.0 | 1.85 |
| SAG1000 | 0.2 | 0.18 |
| Maxamyl | 3.5 | 3.24 |
| Maxapem | 4.5 | 4.17 |
| Perfume | 0.1 | 0.09 |
| Water | — | 8.0 |
| Appearance | Fine powder | Large lumps |

It is clear that the inclusion of water in a phosphate containing or a phosphate free composition results in products that contain large lumps and are not free flowing as compared to products that are made without the inclusion of water.

The use of nonionic surfactants in the instant composition at concentrations of 30 wt. % causes both the phosphate and non phosphate containing composition to contain large lumps and not to be free flowing as are the instant compositions which contain less than 15 wt. % of nonionic surfactant as well as either 0.1 or 1.0 wt. % of anti-foaming agent was used in an automatic dishwashing composition there was tremendous foaming with the foam extruding out of the seal along the door (pictures were taken showing this foaming).

EXAMPLE 9

The following two formulas were prepared according to the procedure of Example I and tested for spotting on a scale of 1 to 1 0, wherein 10 is the best rating.

TABLE VIII

| | A (wt. %) | B (wt. %) |
|---|---|---|
| Granular disilicate | 25.0 | 25.0 |
| Soda ash | 26.0 | 23.0 |
| Laponite clay | — | 3.0 |
| Sokalan CP 45 | 10.0 | 10.0 |
| Sodium perborate | 10.0 | 10.0 |
| TAED | 3.0 | 3.0 |
| Maxacal enzyme | 13.0 | 13.0 |
| Maxamyl enzyme | 5.0 | 5.0 |
| Solid caustic soda | 3.0 | 3.0 |
| Synperonic LFD25 | 4.5 | 4.5 |
| Silicone DB100 | 0.5 | 0.5 |
| Spotting | 5.2 | 4.7 |

It is clear that the addition of Laponite clay to formula A which is the instant invention does not improve the spotting and is inferior in spotting to the composition with no clay.

EXAMPLE 10

The following formula was prepared according to the procedure of Example 1.

TABLE IX

| | A |
|---|---|
| Sodium sulphate | 44.2 |
| Sodium Citrate | 17.00 |
| Sodium silicate | 13.0 |
| Sodium carbonate | 8.0 |
| Polytergent SLF 18 | 6.0 |
| Acusol 460ND | 6.0 |
| Goodrite K759 | 2.0 |
| Maxamyl prill | 0.9 |
| Maxacal prill | 2.9 |

This composition was tested against a commercial phosphate containing automatic dishwashing powder and a commercial phosphate liquid gel.

| | % of Soiled Egg | Cleaned Oatmeal | Glass Spot | Plate Spot |
|---|---|---|---|---|
| Commercial Powder | 30 | 80 | 2.3 | 1.2 |
| Commercial Gel | 30 | 80 | 2.4 | 3 |
| Formula A | 55 | 100 | 1.0 | 1.2 |

What is claimed is:

1. A free flowing powdered dishwashing composition having improved enzymes stability consisting essentially of a physical mixture of agglomerated beads having a maximum particle size of less than about 2,000 microns of at least one alkali metal detergent builder salt selected from the group consisting of an alkali metal carbonate and an alkali metal citrate and mixtures thereof, an alkali metal silicate, a low molecular weight noncrosslinked polyacrylate homopolymer, a low molecular weight non crosslinked polyacrylate copolymer, an alkali metal sulfate and a nonionic surfactant and a blend portion of the composition comprising at least one protease enzyme and an amylase enzyme, wherein the maximum particle size of the particles of said blend are less than about 2,000 microns, wherein the agglomerated beads comprises a core of at least one said alkali metal detergent builder salt, said alkali metal silicate, said low molecular weight non crosslinked polyacrylate polymer, said low molecular weight polyacrylate copolymer, and said alkali metal sulfate and a coating absorbed on said core of said alkali metal detergent builder salt, said alkali metal silicate, said low molecular weight noncrosslinked polyacrylate homopolymer, said low molecular weight polyacrylate copolymer, and said alkali metal sulfate, said coating comprising said nonionic surfactant, wherein the dishwashing composition consisting essentially of approximately by weight:

(a) 2 to 40 percent of at least one said alkali metal detergent builder salt;

(b) 3 to 30 percent of said alkali metal silicate;

(c) 1 to 10 percent of said low molecular weight non crosslinked polyacrylate homopolymer;

(d) 1.0 to 12.0 percent of said nonionic surfactant;

(e) 0 to 1.5 percent of said anti-foaming agent;

(f) 0.5 to 6.0% of said low molecular weight noncrosslinked polyacrylate copolymer, said copolymer being selected from the group consisting of a copolymer of an acrylate and olefin and a copolymer of an acrylate and maleic anhydride;

(g) 5 to 45% of said alkali metal sulfate;

(h) 0.5 to 15.0 percent of at least one said protease enzyme; and (i) 0.3 to 8.0 percent of said amylase enzyme, said composition having less than 8.0 weight percent of water.

2. The composition according to claim 1 further including about 0.5 to about 17.0 weight percent of an alkali metal perborate, such alkali metal perborate being mixed in said blend portion of at least one said protease enzyme and said amylase enzyme.

3. The composition according to claim 2 further including 0.1 to 5.0 weight percent of an alkali metal perborate activator, said alkali metal perborate activator being mixed-in said blend of at least one said protease enzyme said amylase enzyme, and said alkali metal perborate.

4. The composition according to claim 2, further including 0 to about 8.0 weight percent of a lipase enzyme.

5. The composition according to claim 1 further including about 0.5 to about 20.0 weight percent of an alkali metal perborate, said alkali metal perborate being disposed in said core of said agglomerated beads.

6. The composition according to claim 1 further including about 0.1 to about 20.0 weight percent of a sodium alumino silicate.

7. A free flowing powdered dishwashing composition having improved enzymes stability consisting essentially of a physical mixture of agglomerated beads having a maximum particle size of less than about 2,000 microns of at least one alkali metal detergent builder salt selected from the group consisting of an alkali metal carbonate and an alkali metal citrate and mixtures thereof, an alkali metal silicate, a low molecular weight noncrosslinked polyacrylate homopolymer, a low molecular weight noncrosslinked polyacrylate copolymer, an alkali metal sulfate and a nonionic surfactant and a blend portion of the composition comprising at least one protease enzyme, and an amylase enzyme, wherein the maximum particle size of the particles of said blend are less than about 2,000 microns, wherein the agglomerated beads comprises a core of at least one said alkali metal detergent builder salt and said alkali metal silicate and a coating absorbed on said core of said alkali metal detergent builder salt and said alkali metal silicate, said coating comprising a mixture of said nonionic surfactant, said low molecular weight noncrosslinked polyacrylate homopolymer, said low molecular weight noncrosslinked polyacrylate copolymer, and said alkali metal sulfate, wherein the dishwashing composition consisting essentially of approximately by weight:

(a) 2 to 40 percent of at least one said alkali metal detergent builder salt;

(b) 3 to 30 percent of said alkali metal silicate;

(c) 1 to 10 percent of said low molecular weight non crosslinked polyacrylate homopolymer;

(d) 1.0 to 12.0 percent of said nonionic surfactant;

(e) 0 to 1.5 percent of said anti-foaming agent;

(f) 0.5 to 6% of a low molecular weight noncrosslinked polyacrylate copolymer, said copolymer being selected from the group consisting of a copolymer of an acrylate and olefin and a copolymer of an acrylate and maleic anhydride;

(g) 5 to 45% of an alkali metal sulfate;

(h) 0.5 to 15.0 percent of at least one said protease enzyme; and (i) 0.3 to 8.0 percent of said amylase enzyme, said composition having less than 8.0 weight percent of water.

8. The composition according to claim 7 further including about 0.5 to about 17.0 weight percent of an alkali metal perborate, said alkali metal perborate being mixed in said blend portion of at least one said protease enzyme and said amylase enzyme.

9. The composition according to claim 8 further including 0.1 to 5.0 weight percent of an alkali metal perborate activator, said alkali metal perborate activator being mixed in said blend of at least one said protease enzyme, said amylase enzyme, and said alkali metal perborate.

10. The composition according to claim 7, further including 0 to about 8.0 weight percent of a lipase enzyme.

11. The composition according to claim 7 further including about 0.5 to about 20.0 weight percent of an alkali metal perborate, said alkali metal perborate being disposed in said core of said agglomerated beads.

12. The composition according to claim 7 further including about 0.1 to about 20.0 weight percent of a sodium alumino silicate.

13. A free flowing powdered dishwashing composition having improved enzymes stability consisting essentially of a physical mixture of agglomerated beads having a maximum particle size of less than about 2,000 microns of at least one alkali metal detergent builder salt selected from the group consisting of an alkali metal carbonate and an alkali metal citrate and mixtures thereof, an alkali metal silicate, a low molecular weight noncrosslinked polyacrylate homopolymer, a low molecular weight noncrosslinked polyacrylate copolymer, an alkali metal sulfate and a nonionic surfactant and a blend portion of the composition comprising at least one protease enzyme and an amylase enzyme wherein the maximum particle size of the particles of said blend are less than about 2,000 microns, wherein the agglomerated beads comprises a core of at least one said alkali metal detergent builder salt, said low molecular weight noncrosslinked polyacrylate homopolymer, said alkali metal sulfate and said low molecular weight non crosslinked polyacrylate copolymer and a first coating absorbed on said core of said alkali metal detergent builder salt, said low molecular weight noncrosslinked polyacrylate homopolymer, said alkali metal sulfate and said low molecular weight non crosslinked polyacrylate copolymer, said first coating comprising said nonionic surfactant and a second coating deposited on said first coating, said second coating comprising said alkali metal silicate, wherein the dishwashing composition consists essentially of approximately by weight:

(a) 2 to 40 percent of at least one said alkali metal detergent builder salt;

(b) 3 to 30 percent of said alkali metal silicate;

(c) 1 to 10 percent of said low molecular weight non crosslinked polyacrylate homopolymer;

(d) 1.0 to 12.0 percent of said nonionic surfactant;

(e) 0 to 1.5 percent of said anti-foaming agent;

(f) 0.5 to 6.0% of a said low molecular weight non crosslinked polyacrylate copolymer, said Copolymer being selected from the group consisting of a copolymer of an acrylate and olefin and a copolymer of an acrylate and maleic anhydride;

(g) 4 to 45% of said alkali metal sulfate;

(h) 0.5 to 15.0 percent of at least one said protease enzyme; and (i) 0.3 to 8.0 percent of said amylase enzyme, said composition having less than 8.0 weight percent of water.

14. The composition according to claim 13 further including about 0.5 to about 17.0 weight percent of an alkali metal perborate, said alkali metal perborate being mixed in said blend portion of at least one said protease enzyme and said amylase enzyme.

15. The composition according to claim 14 further including 0.1 to 5.0 weight percent of an alkali metal perborate activator, said alkali metal perborate activator being mixed in said blend of at least one said protease enzyme, said amylase enzyme and said alkali metal perborate.

16. The composition according to claim 13, further including 0 to about 8.0 weight percent of a lipase enzyme.

17. The composition according to claim 13 further including about 0.5 to about 20.0 weight percent of an alkali metal perborate, said alkali metal perborate being disposed in said core of said agglomerated beads.

18. The composition according to claim 17 further including about 0.1 to about 5.0 weight percent of an alkali metal perborate activator, said alkali metal perborate activator being mixed in said blend of at least one said protease enzyme and said amylase enzyme.

19. The composition according to claim 13 further including about 0.1 to about 20.0 weight percent of a sodium alumino silicate.

20. A free tic;wing powdered automatic dishwashing composition which consists essentially of approximately by weight:

(a) 2.0 to 40.0 percent of at least one alkali metal detergent builder salt, said detergent builder salt being selected from the group consisting of an alkali metal carbonates and an alkali metal citrates and mixtures thereof; and (b) 1 to 10.0 percent of a low molecular weight polyacrylate homopolymer;

(c) 1.0 to 12.0 percent of a liquid nonionic surfactant;

(d) 3 to 30.0 percent of an alkali metal silicate;

(e) 0 to 1.5 percent of an anti-foaming agent;

(f) 0.5 to 6% of a low molecular noncrosslinked polyacrylate copolymer, said copolymer being selected from the group consisting of a copolymer of an acrylate and olefin and a copolymer of an acrylate and maleic anhydride;

(g) 5 to 45% of an alkali metal sulfate;

(h) 0.5 to 15.0 percent of a protease enzyme derived from bacillus alcalophylus;

(i) 0.3 to 8.0 percent of an amylase enzyme, the individual powdered particles of said composition having a maximum particle size of less than about 2,000 microns and said composition having less than 8.0 weight percent of water.

21. The powdered dishwashing composition according to claim 20 wherein said dishwashing composition further contains 0 to about 8.0 weight percent of a lipase enzyme.

22. The powdered dishwashing composition according to claim 20 which further contains 0.5 to about 17 wt. percent of an alkali metal perborate.

23. The powdered dishwashing composition according to claim 22 which contains 0 to about 5 wt. percent of an alkali metal perborate activator.

24. The powdered dishwashing composition according to claim 22 which contains 0 to about 8.0 weight percent of a lipase enzyme.

25. The powdered dishwashing composition according to claim 22 further including 0 to about 20 weight percent of a sodium alumino silicate.

* * * * *